US011473157B2

(12) United States Patent
Yamashita et al.

(10) Patent No.: US 11,473,157 B2
(45) **Date of Patent: *Oct. 18, 2022**

(54) METHOD FOR MANUFACTURING ALLOY RIBBON PIECE

(71) Applicant: TOYOTA JIDOSHA KABUSHIKI KAISHA, Toyota (JP)

(72) Inventors: Osamu Yamashita, Toyota (JP); Yu Takanezawa, Nisshin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 113 days.

This patent is subject to a terminal disclaimer.

(21) Appl. No.: 16/807,935

(22) Filed: Mar. 3, 2020

(65) Prior Publication Data

US 2020/0283860 A1 Sep. 10, 2020

(30) Foreign Application Priority Data

Mar. 5, 2019 (JP) ..... JP2019-039347

(51) Int. Cl.
*C21D 1/34* (2006.01)
*C22C 1/00* (2006.01)
*C22C 45/00* (2006.01)

(52) U.S. Cl.
CPC ..... *C21D 1/34* (2013.01); *C22C 1/002* (2013.01); *C21D 2201/03* (2013.01); *C22C 45/008* (2013.01)

(58) Field of Classification Search
None
See application file for complete search history.

(56) References Cited

U.S. PATENT DOCUMENTS 4,265,684 A * 5/1981 Boll ..... C21D 6/00 148/121
7,540,899 B1 * 6/2009 Johnson ..... A61L 27/04 148/561

(Continued)

FOREIGN PATENT DOCUMENTS

JP 2003-213331 A 7/2003
JP 2017-141508 A 8/2017
JP 2018-125475 A 8/2018

OTHER PUBLICATIONS

Office Action dated Sep. 21, 2021 in U.S. Appl. No. 16/808,975.

(Continued)

*Primary Examiner* — George Wyszomierski
(74) *Attorney, Agent, or Firm* — Sughrue Mion, PLLC

(57) ABSTRACT

A method for manufacturing an alloy ribbon piece capable of manufacturing a nanocrystalline alloy ribbon piece is provided. The method for manufacturing an alloy ribbon piece according to the present disclosure is a method for manufacturing an alloy ribbon piece obtained by crystallizing an amorphous alloy ribbon piece, and includes: preparing the amorphous alloy ribbon piece; sequentially heating the amorphous alloy ribbon piece from one end to an intermediate position toward another end to a temperature range equal to or more than a crystallization starting temperature, and stopping the heating when heating the amorphous alloy ribbon piece up to the intermediate position to the temperature range; and heating a region on the other end side with respect to the intermediate position of the amorphous alloy ribbon piece to the temperature range equal after the stopping of the heating in the sequentially heating.

3 Claims, 10 Drawing Sheets

(56) References Cited

U.S. PATENT DOCUMENTS

| | | | | |
|---|---|---|---|---|
| 2014/0007989 | A1* | 1/2014 | Prest | C22C 1/00 148/537 |
| 2017/0229237 | A1 | 8/2017 | Makino et al. | |
| 2020/0283861 | A1* | 9/2020 | Takanezawa | C21D 1/34 |

OTHER PUBLICATIONS

Final Office Action dated Feb. 28, 2022 by the USPTO in U.S. Appl. No. 16/808,975.
Notice of Allowance dated Jun. 7, 2022 by the USPTO in U.S. Appl. No. 16/808,975.

* cited by examiner

METHOD FOR MANUFACTURING ALLOY RIBBON PIECE

CROSS REFERENCE TO RELATED APPLICATIONS

The present application claims priority from Japanese patent application JP 2019-039347 filed on Mar. 5, 2019, the content of which is hereby incorporated by reference into this application.

BACKGROUND

Technical Field

The present disclosure relates to a method for manufacturing an alloy ribbon piece obtained by crystallizing an amorphous alloy ribbon piece.

Description of Related

Conventionally, since an amorphous alloy ribbon piece is a soft magnetic material, the amorphous alloy ribbon pieces punched from a continuous amorphous alloy ribbon manufactured by a method such as a single roll method and a twin roll method are used for, for example, a motor core. Since a nanocrystalline alloy ribbon piece obtained by crystallizing the amorphous alloy ribbon piece is a soft magnetic material that can provide a high saturation magnetic flux density and a low coercivity at the same time, recently, the nanocrystalline alloy ribbon piece has been used for those cores.

When the nanocrystalline alloy ribbon piece is manufactured through crystallization of the amorphous alloy ribbon piece by heating the amorphous alloy ribbon piece to a temperature equal to or more than a crystallization starting temperature, generated heat due to crystallization of the amorphous alloy ribbon piece causes an excessive temperature rise of the alloy ribbon piece, and as a result, coarse crystal grains and precipitation of a compound phase occur to possibly deteriorate soft magnetic properties.

As a method for dealing with such a problem, for example, JP 2017-141508 A discloses a method for absorbing the generated heat due to crystallization by plates on both ends in a method for crystallizing an amorphous alloy ribbon piece by heating with the plates between which the amorphous alloy ribbon piece is sandwiched.

For example, JP 2018-125475 A discloses a method for crystallizing an amorphous alloy ribbon piece by raising temperature of the amorphous alloy ribbon piece in a furnace at a high speed. With this method, it is considered that uniformly heating each position of the amorphous alloy ribbon piece can suppress excessive temperature rise of the alloy ribbon piece caused by the generated heat due to crystallization.

SUMMARY

However, as the method disclosed in JP 2017-141508 A, with the method to reduce the excessive temperature rise to suppress the coarse crystal grains and the like by performing the operation to absorb the generated heat due to crystallization using an additionally prepared endothermic member, the nanocrystalline alloy ribbon piece cannot be manufactured with high productivity.

As the method disclosed in JP 2018-125475 A, with the method to raise the temperature of the amorphous alloy ribbon piece in the furnace, it is actually difficult to uniformly heat each position to crystallize the amorphous alloy ribbon piece. Therefore, heat accumulation caused by the generated heat due to crystallization occurs on the alloy ribbon piece to cause the excessive temperature rise, thus resulted in the deterioration of the soft magnetic properties in some cases.

The present disclosure has been made in view of such an aspect, and provides a method for manufacturing an alloy ribbon piece capable of manufacturing a nanocrystalline alloy ribbon piece obtained by crystallizing an amorphous alloy ribbon piece with high productivity.

To solve the above-described problem, a method for manufacturing an alloy ribbon piece according to the present disclosure is a method for manufacturing an alloy ribbon piece obtained by crystallizing an amorphous alloy ribbon piece. The method includes: preparing the amorphous alloy ribbon piece; sequentially heating the amorphous alloy ribbon piece from one end to an intermediate position toward another end to a temperature range equal to or more than a crystallization starting temperature, and stopping the heating when heating the amorphous alloy ribbon piece up to the intermediate position to the temperature range equal to or more than the crystallization starting temperature; and heating a region on the other end side with respect to the intermediate position of the amorphous alloy ribbon piece to the temperature range equal to or more than the crystallization starting temperature after the stopping of the heating in the sequentially heating.

EFFECT

The present disclosure ensures manufacturing the nanocrystalline alloy ribbon piece obtained by crystallizing the amorphous alloy ribbon piece with high productivity.

DETAILED DESCRIPTION OF THE EMBODIMENTS

The following describes an embodiment of a method for manufacturing an alloy ribbon piece according to the present disclosure.

The embodiment of the method for manufacturing an alloy ribbon piece according to the present disclosure is a method for manufacturing an alloy ribbon piece obtained by crystallizing an amorphous alloy ribbon piece, the method includes: a preparation step of preparing the amorphous alloy ribbon piece; a first heat treatment step of sequentially heating the amorphous alloy ribbon piece from one end to an intermediate position toward another end to a temperature range equal to or more than a crystallization starting temperature, and stopping the heating when heating the amorphous alloy ribbon piece up to the intermediate position to the temperature range equal to or more than the crystallization starting temperature; and a second heat treatment step of heating a region on the other end side with respect to the intermediate position of the amorphous alloy ribbon piece to the temperature range equal to or more than the crystallization starting temperature after the stopping of the heating in the first heat treatment step. Hereinafter, a direction perpendicular to a direction from the one end to the other end of the amorphous alloy ribbon piece is referred to as "width direction."

First, an embodiment of the method for manufacturing an alloy ribbon piece according to the present disclosure will be described with an example.

Here, FIG. 1A to FIG. 2B are schematic process drawings illustrating the exemplary embodiment of the method for manufacturing an alloy ribbon piece according to the disclosure. FIG. 3 is an exemplary DSC curve of an amorphous alloy measured with a differential scanning calorimeter (DSC).

Figure 1A:
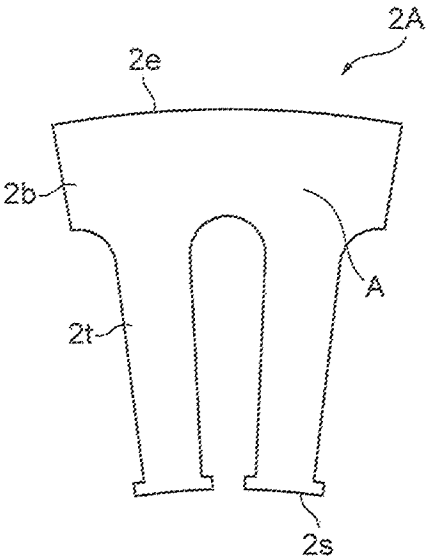
FIGS. 1A to 1C are schematic process drawings illustrating an exemplary embodiment of a method for manufacturing an alloy ribbon piece according to the disclosure.

In the exemplary manufacturing method of the embodiment, first, punching a continuous sheet-shaped amorphous alloy ribbon (not illustrated), which is manufactured by a common method with a press machine (not illustrated), prepares an amorphous alloy ribbon piece 2A as illustrated in FIG. 1A (preparation step). Since the amorphous alloy ribbon piece 2A has a shape into which a circular alloy ribbon constituting a motor stator core is divided, the amorphous alloy ribbon piece 2A has a teeth portion 2*t* on an inner edge (one end) 2*s* side, and a back yoke portion 2*b* on an outer edge (other end) 2*e* side.

Figure 1B:
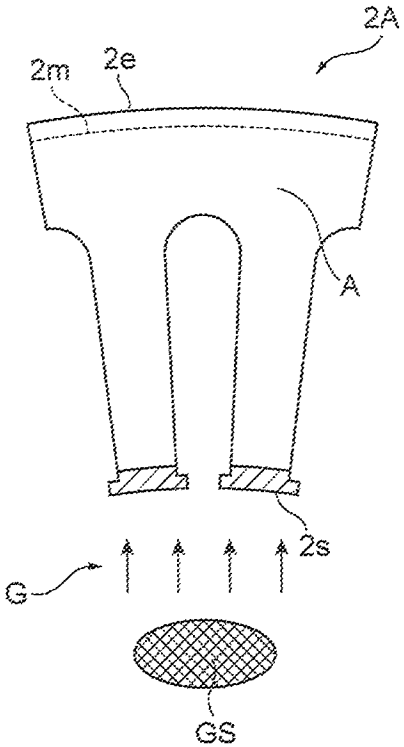
Figure 1C:
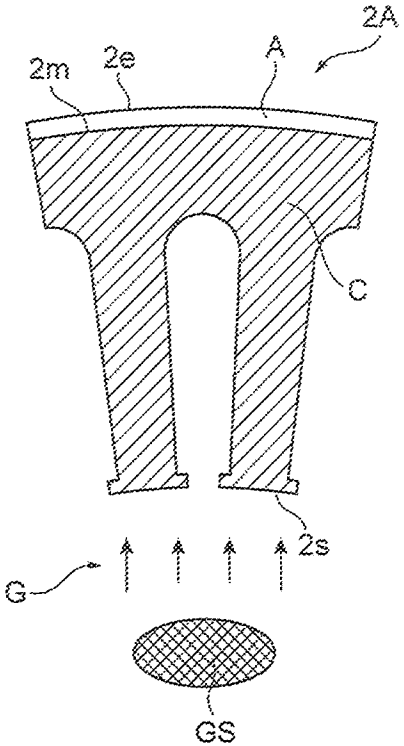
Figure 2A:
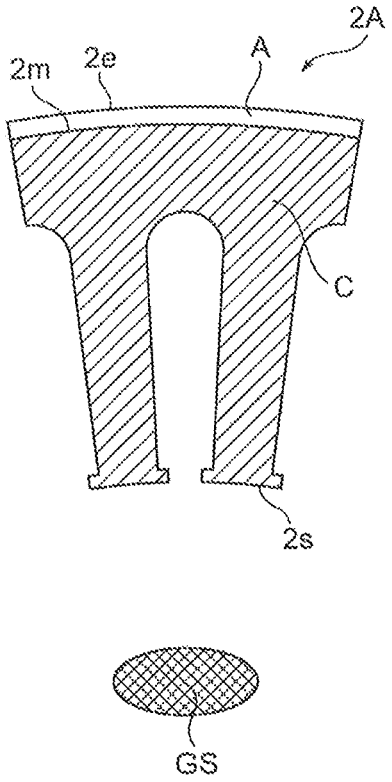
FIGS. 2A and 2B are schematic process drawings illustrating the exemplary embodiment of the method for manufacturing an alloy ribbon piece according to the disclosure.
Figure 3:
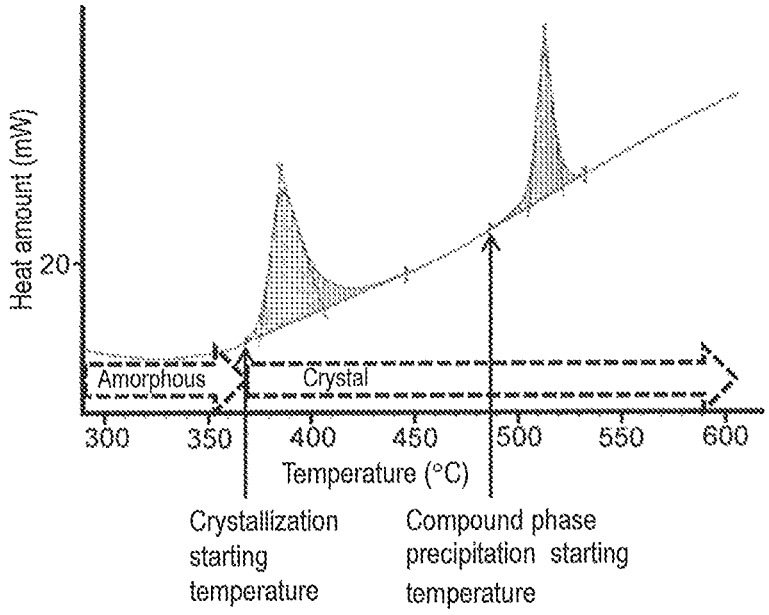
FIG. 3 is a graph illustrating a DSC curve of an amorphous alloy measured with a differential scanning calorimeter (DSC)

Next, as illustrated in FIG. 1B and FIG. 1C, in a state where the amorphous alloy ribbon piece 2A is put under an air atmosphere at normal temperature, a high temperature gas G at 420° C. is sent for 10 seconds with a velocity of 2.5 m/s from a high temperature gas source GS, which is fixed at a position facing the inner edge 2*s* of the amorphous alloy ribbon piece 2A, toward the amorphous alloy ribbon piece 2A, the high temperature gas G is thereby applied to the amorphous alloy ribbon piece 2A, and subsequently, the sending of the high temperature gas G is stopped as illustrated in FIG. 2A. Thus, the whole region in the width direction is sequentially heated from the inner edge 2*s* to an intermediate position 2*m* toward the outer edge 2*e* of the amorphous alloy ribbon piece 2A to a temperature range equal to or more than a crystallization starting temperature, and when the whole region in the width direction up to the intermediate position 2*m* is heated to the temperature range equal to or more than the crystallization starting temperature, the heating of the amorphous alloy ribbon piece 2A is stopped (first heat treatment step). Accordingly, for the amorphous alloy ribbon piece 2A, the amorphous alloy A in the region from the inner edge 2*s* to the intermediate position 2*m* is crystallized to obtain a nanocrystalline alloy C, and a region on the outer edge 2*e* side with respect to the intermediate position 2*m* is kept in a temperature range less than the crystallization starting temperature.

Figure 2B:
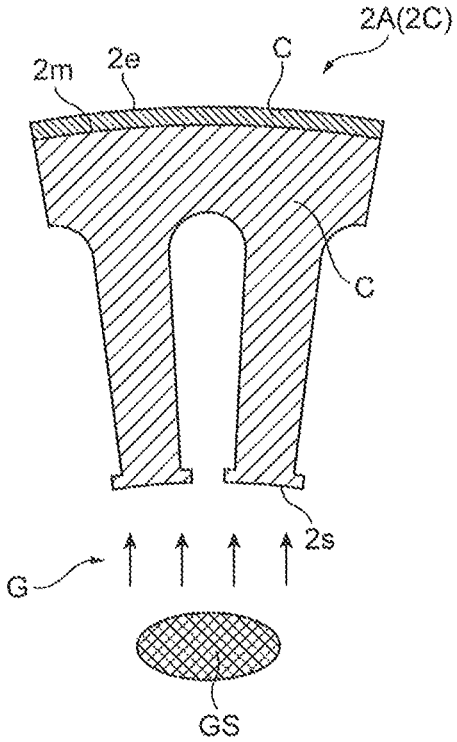

Next, as illustrated in FIG. 2A, after an elapse of one second from the stop of the sending of the high temperature gas G in the first heat treatment step, as illustrated in FIG. 2B, the high temperature gas G at 450° C., which is higher than that in the first heat treatment step, is sent for 10 seconds with a velocity of 2.5 m/s from the same high temperature gas source GS fixed at the same position toward the amorphous alloy ribbon piece 2A, the high temperature gas G is thereby applied to the amorphous alloy ribbon piece 2A, and subsequently, the sending of the high temperature gas G is stopped. Thus, the whole region in the width direction is sequentially heated from the inner edge 2*s* to the outer edge 2*e* of the amorphous alloy ribbon piece 2A to the temperature range equal to or more than the crystallization starting temperature at a timing later than the timing at which the heating is stopped in the first heat treatment step, the whole of the amorphous alloy ribbon piece 2A including the region on the outer edge 2*e* side with respect to the intermediate position 2*m* is thereby heated to the temperature range equal to or more than the crystallization starting temperature, and subsequently, the heating is stopped (second heat treatment step). Accordingly, in the region on the outer edge 2*e* side with respect to the intermediate position 2*m* of the amorphous alloy ribbon piece 2A, the amorphous alloy A is crystallized to obtain the nanocrystalline alloy C. As described above, a nanocrystalline alloy ribbon piece 2C obtained by crystallizing the whole of the amorphous alloy ribbon piece 2A is manufactured.

Accordingly, with the one example of the embodiment, as seen from the DSC curve of FIG. 3, when a heat due to crystallization is sequentially generated from the inner edge 2*s* to the intermediate position 2*m* of the amorphous alloy ribbon piece 2A by the heating in the first heat treatment step, the generated heat can be escaped to the region on the outer edge 2*e* side with respect to the intermediate position 2*m* kept in a temperature range less than the crystallization starting temperature. Furthermore, accordingly, when the whole of the amorphous alloy ribbon piece 2A is heated to the temperature range equal to or more than the crystallization starting temperature in the second heat treatment step, the inner edge 2*s* to the intermediate position 2*m* thereof has a temperature range lower than the temperature (for example, about 500° C.) further increased by the generated heat due to crystallization. Therefore, as seen from the DSC curve of FIG. 3, even if the heat due to crystallization in the region on the outer edge 2*e* side with respect to the intermediate position 2*m* is generated, the generated heat can be escaped to a region on the inner edge 2*s* side with respect to the intermediate position 2*m*. Accordingly, in the crystallization of the amorphous alloy ribbon piece 2A, an excessive temperature rise can be reduced and coarse crystal grains and precipitation of a compound phase can be suppressed without performing an operation to absorb the generated heat due to crystallization using an additionally prepared endothermic member.

Figure 4:
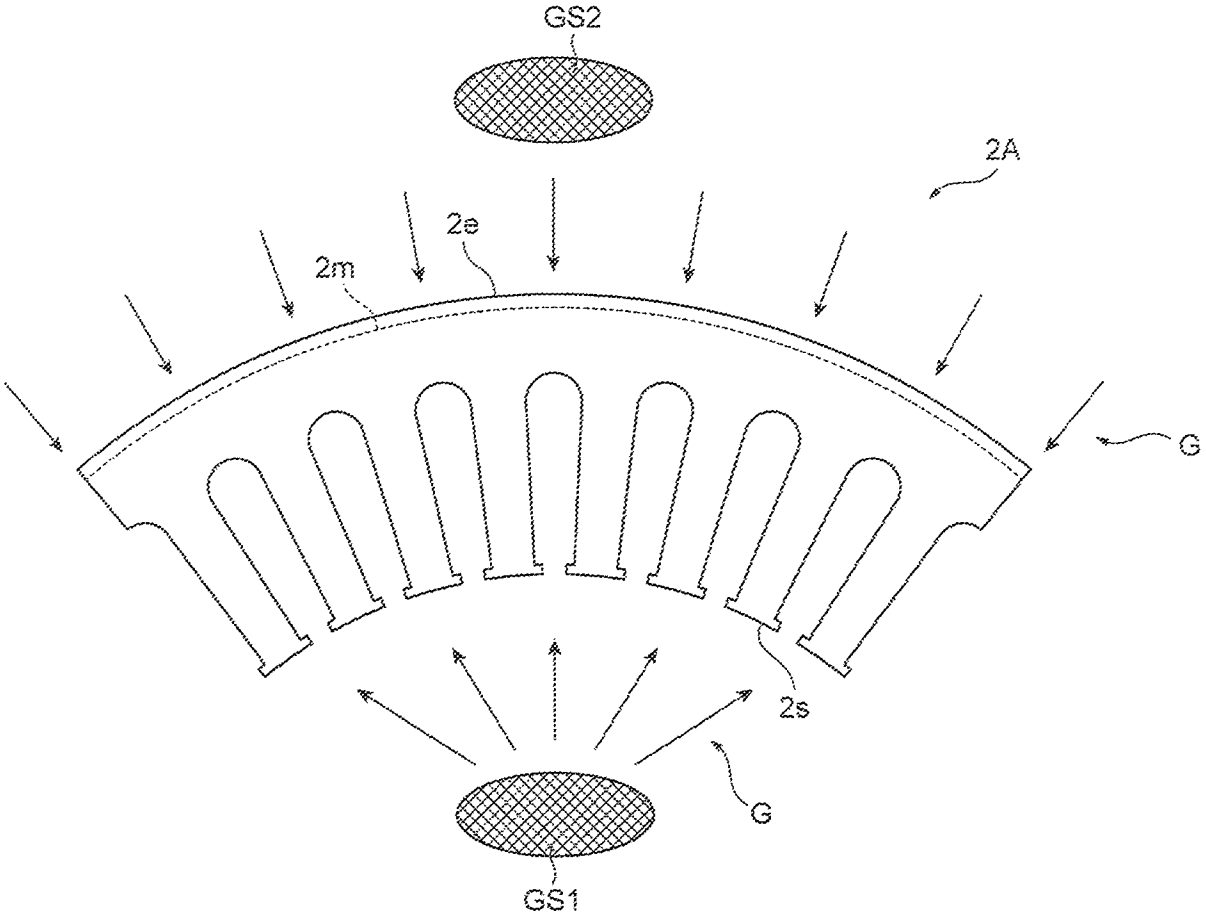
FIG. 4 is a schematic drawing illustrating a method for manufacturing an alloy ribbon piece of a reference example.

Here, a method for manufacturing an alloy ribbon piece of the reference example will be described mainly for difference from the one example according to the embodiment. FIG. 4 is a schematic drawing illustrating the method for manufacturing an alloy ribbon piece of the reference example.

In the method for manufacturing an alloy ribbon piece of the reference example, as illustrated in FIG. 4, in a state where the amorphous alloy ribbon piece 2A having the shape into which a circular alloy ribbon constituting a stator core is divided is put under the air atmosphere at normal temperature, sending a high temperature gas G from a first high temperature gas source GS1 facing the inner edge 2*s* of the amorphous alloy ribbon piece 2A sequentially heats from the inner edge 2*s* to the intermediate position 2*m* toward the outer edge 2*e* of the amorphous alloy ribbon piece 2A to the temperature range equal to or more than the crystallization starting temperature, and the sending of the high temperature gas G is stopped when heating the amorphous alloy ribbon piece 2A up to the intermediate position 2*m* to the temperature range equal to or more than the crystallization starting temperature. At a timing later than the timing of stopping the heating, the high temperature gas G is thus sent from a second high temperature gas source GS2 facing the outer edge 2*e* of the amorphous alloy ribbon piece 2A, and thus sequentially heating the amorphous alloy ribbon piece 2A from the outer edge 2*e* to the positon immediately before the intermediate position 2*m* to the temperature range equal to or more than the crystallization starting temperature. Accordingly, when the heat due to crystallization is sequentially generated from the inner edge 2*s* to the intermediate position 2*m* of the amorphous alloy ribbon piece 2A by the first heating by the first high temperature gas source GS1, the generated heat can be escaped to the region on the outer edge 2*e* side with respect to the intermediate position 2*m* kept in the temperature range less than the crystallization starting temperature. Furthermore, accordingly, from the inner edge 2*s* to the intermediate position 2*m* of the amorphous alloy ribbon piece 2A, the temperature range becomes, for example, lower than the temperature further increased by the generated heat due to crystallization. Therefore, when the heat due to crystallization is sequentially generated from the outer edge 2*e* to the positon immediately before the intermediate position 2*m* of the amorphous alloy ribbon piece 2A by the second heating by the second high temperature gas source GS2, the generated heat can be escaped to the region on the inner edge 2*s* side with respect to the intermediate position 2*m*. Accordingly, similarly to the one example of the embodiment, the excessive temperature rise can be reduced without performing the operation to absorb the heat using an additionally prepared endothermic member.

However, to heat the amorphous alloy ribbon piece 2A from both sides of the inner edge 2*s* and the outer edge 2*e* having different shapes, it is necessary to use manufacturing equipment that includes two different types of the first high temperature gas source GS1 and the second high temperature gas source GS2 as the high temperature gas sources at the positions facing the inner edge 2*s* and the outer edge 2*e*. When the high temperature gas G is sent from one of these high temperature gas sources, the other high temperature gas source needs to be evacuated to avoid inappropriate heating of the amorphous alloy ribbon piece 2A due to the fail in smooth sending of the high temperature gas G interfered by the other high temperature gas source. Therefore, it is necessary to employ the manufacturing equipment that further includes a mechanism to evacuate the other high temperature gas source. Accordingly, the manufacturing equipment becomes complicated and expensive. In contrast, the one example of the embodiment can use simple and low-price manufacturing equipment that includes only one high temperature gas source GS facing the inner edge 2*s* as the high temperature gas source without that mechanism.

In the embodiment, as the one example according to the embodiment, the first heat treatment step sequentially heats the amorphous alloy ribbon piece from one end to the intermediate position toward the other end to the temperature range equal to or more than the crystallization starting temperature, and the heating is stopped when heating the amorphous alloy ribbon piece up to the intermediate position to the temperature range equal to or more than the crystallization starting temperature. The second heat treatment step heats the region on the other end side with respect to the intermediate position of the amorphous alloy ribbon piece to the temperature range equal to or more than the crystallization starting temperature after the heating is stopped in the first heat treatment step. Accordingly, when the heat due to crystallization is sequentially generated from the one end to the intermediate position of the amorphous alloy ribbon piece by the heating in the first heat treatment step, the generated heat can be escaped to the region on the other end side with respect to the intermediate position kept in the temperature range less than the crystallization starting temperature, and when the heat due to crystallization in the region on the other end side with respect to the intermediate position of the amorphous alloy ribbon piece is generated by the heating in the second heat treatment step, the generated heat can be escaped to, for example, the region on the one end side with respect to the intermediate position having the temperature range lower than the temperature further increased by the generated heat due to crystallization. Accordingly, in the crystallization of the amorphous alloy ribbon piece, the excessive temperature rise can be reduced and the coarse crystal grains and the precipitation of the compound phase can be suppressed without performing the operation to absorb the generated heat due to crystallization using an additionally prepared endothermic member. Therefore, the nanocrystalline alloy ribbon piece obtained by crystallizing the amorphous alloy ribbon piece can be manufactured with high productivity. Furthermore, the simple and low-price manufacturing equipment that includes only a high temperature heat source facing the one end of the amorphous alloy ribbon piece as the high temperature heat source can be used.

Next, the method for manufacturing an alloy ribbon piece according to the embodiment will be described in detail mainly for the conditions.

1. Preparation Step

In the preparation step, the amorphous alloy ribbon piece is prepared.

Here, the "amorphous alloy ribbon piece" means a ribbon piece, which is used for, for example, a component such as a core in a final product such as a motor, punched in a desired shape from a continuous sheet-shaped amorphous alloy ribbon manufactured by a common method such as a single roll method and a twin roll method.

While the amorphous alloy ribbon piece is not specifically limited insofar as the amorphous alloy ribbon piece is a ribbon piece punched in the desired shape, for example, a ribbon constituting a stator core or a rotor core of a motor and a ribbon obtained by further dividing the ribbon constituting the stator core in a circumferential direction are included.

While the material of the amorphous alloy ribbon piece is not specifically limited insofar as the material is the amorphous alloy, for example, a Fe-based amorphous alloy, a Ni-based amorphous alloy, and a Co-based amorphous alloy are included. Especially, the Fe-based amorphous alloy and the like may be used. Here, the "Fe-based amorphous alloy" means an amorphous alloy that contains Fe as a main component, and contains impurities such as B, Si, C, P, Cu, Nb, and Zr. The "Ni-based amorphous alloy" means an amorphous alloy that contains Ni as a main component. The "Co-based amorphous alloy" means an amorphous alloy that contains Co as a main component.

The Fe-based amorphous alloy may have, for example, a Fe content in a range of 84 atomic percent or more, and has have a larger Fe content in some embodiments. This is because a magnetic-flux density of the alloy ribbon piece obtained by crystallizing the amorphous alloy ribbon piece differs depending on the Fe content.

The plane size of the amorphous alloy ribbon piece is not specifically limited, but includes, for example, a common plane size of a ribbon constituting the stator core or the rotor core of the motor and a ribbon into which the ribbon constituting the stator core is further divided in the circumferential direction. The thickness of the amorphous alloy ribbon piece is not specifically limited, but different depending on the material and the like of the amorphous alloy ribbon piece. When the material is the Fe-based amorphous alloy, the thickness is, for example, in a range of 10 μm or more and 100 μm or less, and may be in a range of 20 μm or more and 50 μm or less.

2. First Heat Treatment Step

The first heat treatment step sequentially heats the amorphous alloy ribbon piece from the one end to the intermediate position toward the other end to the temperature range equal to or more than the crystallization starting temperature, and the heating is stopped when heating the amorphous alloy ribbon piece up to the intermediate position to the temperature range equal to or more than the crystallization starting temperature. Specifically, the first heat treatment step sequentially heats the amorphous alloy ribbon piece from the one end to the intermediate position toward the other end to the temperature range equal to or more than the crystallization starting temperature and keeps the temperature range for a time required for crystallization, and the heating of the amorphous alloy ribbon piece is stopped to avoid having the temperature range equal to or more than the crystallization starting temperature in the region on the other end side with respect to the intermediate position when heating the amorphous alloy ribbon piece up to the intermediate position to the temperature range equal to or more than the crystallization starting temperature and keeping the temperature range for the time required for crystallization.

Here, the "one end of the amorphous alloy ribbon piece" means one end in the planar direction of the amorphous alloy ribbon piece, and the "other end of the amorphous alloy ribbon piece" means an end on the opposite side in the planar direction to the one end of the amorphous alloy ribbon piece.

The "crystallization starting temperature" means a temperature at which the crystallization of the amorphous alloy ribbon piece starts when the amorphous alloy ribbon piece is heated. The crystallization of the amorphous alloy ribbon piece differs depending on the material and the like of the amorphous alloy ribbon piece, and when the material is the Fe-based amorphous alloy, for example, the crystallization is a reaction where a fine bccFe crystal precipitates. The crystallization starting temperature differs depending on the material and the like of the amorphous alloy ribbon piece and a heating rate. The crystallization starting temperature tends to become high with the increased heating rate, and in the case of the Fe-based amorphous alloy, for example, the crystallization starting temperature is in a range of 350° C. to 500° C.

The temperature range equal to or more than the crystallization starting temperature is not specifically limited, but may be a temperature range less than a compound phase precipitation starting temperature. Because the precipitation of the compound phase can be suppressed. Here, the "compound phase precipitation starting temperature" means a temperature at which the precipitation of the compound phase starts when the amorphous alloy ribbon piece after the start of the crystallization is further heated, for example, as indicated by the DSC curve of FIG. 3. The "compound phase" means a compound phase that precipitates when the amorphous alloy ribbon piece after the start of the crystallization is further heated and deteriorates the soft magnetic properties, for example, the compound phase such as Fe—B and Fe—P in the case of the Fe-based amorphous alloy.

The temperature range equal to or more than the crystallization starting temperature and less than the compound phase precipitation starting temperature is not specifically limited, but differs depending on the material and the like of the amorphous alloy ribbon piece. When the material is the Fe-based amorphous alloy, the temperature range may be, for example, in a range of equal to or more than the crystallization starting temperature and equal to or less than the crystallization starting temperature +120° C., and may be in a range of equal to or more than the crystallization starting temperature +80° C. and equal to or less than the crystallization starting temperature +120° C. in some embodiments. Because the lower limits or more of these ranges ensures faster crystallization of the amorphous alloy ribbon piece. Because the upper limits or less of these ranges ensures effectively suppressing coarse crystal grains.

The method to stop the heating when heating the amorphous alloy ribbon piece up to the intermediate position to the temperature range equal to or more than the crystallization starting temperature is not specifically limited insofar as it is a method to stop the heating of the amorphous alloy ribbon piece to avoid having the temperature range equal to or more than the crystallization starting temperature in the region on the other end side with respect to the intermediate position. For example, as illustrated in FIG. 2A, the method may be a method to stop the heating of the amorphous alloy ribbon piece from outside at all, or may be a method to stop expansion of the region having the temperature range equal to or more than the crystallization starting temperature to the other end side with respect to the intermediate position while the region from the one end to the intermediate position of the amorphous alloy ribbon piece is heated to the temperature range equal to or more than the crystallization starting temperature. This is because, since the region on the other end side with respect to the intermediate position can be kept in the temperature range less than the crystallization starting temperature with these methods, the generated heat due to crystallization from the one end to the intermediate position can be escaped to the other end side with respect to the intermediate position. The method to stop the heating of the amorphous alloy ribbon piece from outside at all can suppress exposure of the amorphous alloy ribbon piece to a high temperature for a long time to suppress coarse crystal grains.

The method for heating the amorphous alloy ribbon piece is not specifically limited, but includes a method by induction heating and the like in addition to the method to apply the high temperature gas.

The method to apply the high temperature gas includes, for example, as illustrated in FIG. 1B and FIG. 1C, the method to apply the high temperature gas to the amorphous alloy ribbon piece by sending the high temperature gas from the high temperature gas source facing the one end of the amorphous alloy ribbon piece toward the amorphous alloy ribbon piece, and in addition, a method to sequentially apply the high temperature gas from the one end to the intermediate position of the amorphous alloy ribbon piece by moving the high temperature gas source with respect to the amorphous alloy ribbon piece. The heating method may be a heating method with a heat source such as the high temperature gas source facing the one end of the amorphous alloy ribbon piece.

A method for changing the position of the heat source such as the high temperature gas source facing the one end of the amorphous alloy ribbon piece may be any method where the position of the heat source is relatively changed with respect to the amorphous alloy ribbon piece, and a method for moving the heat source such as the high temperature gas source with respect to the amorphous alloy ribbon piece may be any method where the heat source is relatively moved with respect to the amorphous alloy ribbon piece. The high temperature gas source includes, for example, an industrial dryer.

A heating condition is not specifically limited insofar as it is a condition where the heating to the temperature range equal to or more than the crystallization starting temperature is sequentially performed from the one end to the intermediate position of the amorphous alloy ribbon piece and the heating is stopped when heating the amorphous alloy ribbon piece up to the intermediate position to the temperature range equal to or more than the crystallization starting temperature, and the heating condition differs depending on the heating method. When the heating method is the method where the high temperature gas is sent from the high temperature gas source facing the one end of the amorphous alloy ribbon piece toward the amorphous alloy ribbon piece, the heating condition includes a condition where, for example, the temperature of the high temperature gas, the velocity of the high temperature gas, the distance from the one end of the amorphous alloy ribbon piece to the high temperature gas source, the sending time of the high temperature gas, and the temperature of the atmosphere under which the first heat treatment step is performed are set such that the heating to the temperature range equal to or more than the crystallization starting temperature is sequentially performed from the one end to the intermediate position of the amorphous alloy ribbon piece and the heating is stopped when heating the amorphous alloy ribbon piece up to the intermediate position to the temperature range equal to or more than the crystallization starting temperature.

3. Second Heat Treatment Step

In the second heat treatment step, after the heating is stopped in the first heat treatment step, the region on the other end side with respect to the intermediate position of the amorphous alloy ribbon piece is heated to the temperature range equal to or more than the crystallization starting temperature. Specifically, at a timing later than the timing at which the heating of the amorphous alloy ribbon piece is stopped in the first heat treatment step, the region on the other end side with respect to the intermediate position of the amorphous alloy ribbon piece is heated to the temperature range equal to or more than the crystallization starting temperature and kept in the temperature range for the time required for crystallization. Accordingly, the amorphous alloy in the region on the other end side with respect to the intermediate position of the amorphous alloy ribbon piece is crystallized to obtain the nanocrystalline alloy.

Since the temperature range equal to or more than the crystallization starting temperature is similar to that of the first heat treatment step, the description is omitted here.

While the second heat treatment step is not specifically limited insofar as it is a step where the region on the other end side with respect to the intermediate position of the amorphous alloy ribbon piece is heated to the temperature range equal to or more than the crystallization starting temperature after the heating is stopped in the first heat treatment step, the second heat treatment step may be a step where the region on the other end side with respect to the intermediate position is heated to the temperature range equal to or more than the crystallization starting temperature after the elapse of 0.1 seconds or more from the stop of heating in the first heat treatment step, or may be a step where the heating is performed after the elapse of 0.5 seconds or more, or one second or more in some embodiments. This is because, since the region on the other end side with respect to the intermediate position is heated to the temperature range equal to or more than the crystallization starting temperature after the amorphous alloy ribbon piece is cooled from the one end to the intermediate position to the sufficiently low temperature range, the generated heat due to crystallization in the region on the other end side with respect to the intermediate position can be effectively escaped to the region on the one end side with respect to the intermediate position.

While the heating method is not specifically limited, the heating method includes, for example, a method by induction heating in addition to the method to apply the high temperature gas.

The method to apply the high temperature gas includes, for example, as illustrated in FIG. 2B, the method to apply the high temperature gas to the amorphous alloy ribbon piece by sending the high temperature gas from the high temperature gas source facing the one end of the amorphous alloy ribbon piece toward the amorphous alloy ribbon piece, and in addition, a method to apply the high temperature gas to the region on the other end side with respect to the intermediate position of the amorphous alloy ribbon piece by moving the high temperature gas source with respect to the amorphous alloy ribbon piece.

The heating method may be a heating method with a heat source such as the high temperature gas source facing the one end of the amorphous alloy ribbon piece. Since the method for changing the position of the heat source such as the high temperature gas source facing the one end of the amorphous alloy ribbon piece, the method for moving the heat source such as the high temperature gas source with respect to the amorphous alloy ribbon piece, and the high temperature gas source are similar to those in the first heat treatment step, the description is omitted here.

The heating condition is not specifically limited insofar as it is a condition where the region on the other end side with respect to the intermediate position of the amorphous alloy ribbon piece is heated to the temperature range equal to or more than the crystallization starting temperature, and the heating condition differs depending on the heating method. When the heating method is the method where the high temperature gas is sent from the high temperature gas source facing the one end of the amorphous alloy ribbon piece toward the amorphous alloy ribbon piece, the heating condition includes a condition where, for example, the temperature of the high temperature gas, the velocity of the high temperature gas, the distance from the one end of the amorphous alloy ribbon piece to the high temperature gas source, the sending time of the high temperature gas, and the temperature of the atmosphere under which the second heat treatment step is performed are set such that the region on the other end side with respect to the intermediate position of the amorphous alloy ribbon piece is heated to the temperature range equal to or more than the crystallization starting temperature.

4. Method for Manufacturing Alloy Ribbon Piece

With the method for manufacturing an alloy ribbon piece according to the embodiment, the nanocrystalline alloy ribbon piece obtained by crystallizing the amorphous alloy ribbon piece is manufactured.

(1) Nanocrystalline Alloy Ribbon Piece

Here, the "nanocrystalline alloy ribbon piece" means a nanocrystalline alloy ribbon piece that provides soft magnetic properties such as a desired coercivity by precipitating fine crystal grains without substantially causing the precipitation of the compound phase and the coarse crystal grains. The material of the nanocrystalline alloy ribbon piece differs depending on the material and the like of the amorphous alloy ribbon piece, and when the material of the amorphous alloy ribbon piece is the Fe-based amorphous alloy, the material of the nanocrystalline alloy ribbon piece is, for example, a Fe-based nanocrystalline alloy having a mixed phase structure of crystal grains of Fe or Fe alloy (for example, fine bccFe crystal) and amorphous phases.

The grain diameter of the crystal grain of the nanocrystalline alloy ribbon piece is not specifically limited insofar as the desired soft magnetic properties are obtained, and differs depending on the material and the like. When the material is the Fe-based nanocrystalline alloy, for example, the grain diameter may be in a range of 25 nm or less. Because coarsening deteriorates the coercivity. The grain diameter of the crystal grain can be measured through, for example, a direct observation using a transmission electron microscope (TEM). The grain diameter of the crystal grain can be estimated from the coercivity or a temperature profile of the nanocrystalline alloy ribbon piece.

The coercivity of the nanocrystalline alloy ribbon piece differs depending on the material and the like of the nanocrystalline alloy ribbon piece, and when the material is the Fe-based nanocrystalline alloy, the coercivity is, for example, 20 A/m or less and may be 10 A/m or less. This is because, thus decreasing the coercivity ensures effectively reducing, for example, a loss in the core of the motor and the like. The coercivity can be measured using, for example, a vibrating sample magnetometer (VSM).

(2) Method for Manufacturing Alloy Ribbon Piece

Other conditions and the like of the method for manufacturing an alloy ribbon piece will be described.

While the atmosphere, under which the steps included in the method for manufacturing an alloy ribbon piece is performed, is not specifically limited, the atmosphere may include, for example, an air atmosphere.

The temperature of the atmosphere is not specifically limited insofar as it is a temperature at which the heated part of the amorphous alloy ribbon piece is cooled by stopping the heating, and the temperature differs depending on the material and the like of the amorphous alloy ribbon piece. When the material is the Fe-based amorphous alloy, the temperature may be, for example, in a range of 370° C. or less, and is in a range of 200° C. or less in some embodiments. Because the upper limit or less of these ranges ensures effective cooling of the heated part of the amorphous alloy ribbon piece when the heating is stopped. The temperature of the atmosphere may be a normal temperature. The "normal temperature" means a temperature not especially cooled or heated, that is, a room temperature indoor or an air temperature outdoor, and for example, a temperature in a range of 20° C.±15° C. specified in JIS Z 8703.

The method for manufacturing an alloy ribbon piece may be a method where, for example, as the example illustrated in FIG. 1A to FIG. 2B, the heating methods in both steps of the first heat treatment step and the second heat treatment step are the heating methods with the heat source such as the high temperature gas source facing the one end of the amorphous alloy ribbon piece. Because simple and low-price manufacturing equipment can be used.

When the heating methods in both steps of the first heat treatment step and the second heat treatment step are the heating methods with the heat source facing the one end of the amorphous alloy ribbon piece, the heating condition for both steps includes, for example, a relatively low heating condition in the first heat treatment step and a relatively high heating condition in the second heat treatment step.

When the heating method is the method where the high temperature gas is sent from the high temperature gas source facing the one end of the amorphous alloy ribbon piece toward the amorphous alloy ribbon piece, the heating condition for both steps includes, for example, a condition where the temperature of the high temperature gas in the second heat treatment step is higher than that in the first heat treatment step, a condition where the velocity of the high temperature gas in the second heat treatment step is higher than that in the first heat treatment step, a condition where the distance from the one end of the amorphous alloy ribbon piece to the high temperature gas source in the second heat treatment step is shorter than that in the first heat treatment step, and a condition where the sending time of the high temperature gas in the second heat treatment step is longer than that in the first heat treatment step. When the heating condition for both steps is, for example, the condition where the temperature of the high temperature gas in the second heat treatment step is higher than that in the first heat treatment step, the condition where the velocity of the high temperature gas in the second heat treatment step is higher than that in the first heat treatment step, and/or the condition where the distance from the one end of the amorphous alloy ribbon piece to the high temperature gas source in the second heat treatment step is shorter than that in the first heat treatment step, the sending of the high temperature gas does not need to be stopped when the heating is stopped in the first heat treatment step. Because this sending condition of the high temperature gas for both steps ensures stopping the expansion of the region having the temperature range equal to or more than the crystallization starting temperature to the other end side with respect to the intermediate position in the first heat treatment step even in a case where the sending condition of the high temperature gas for both steps is continuously changed without stopping the sending of the high temperature gas when the heating is stopped in the first heat treatment step, thus providing the effect of the embodiment.

When the heating method in each heat treatment step is the heating method with the heat source facing the one end of the amorphous alloy ribbon piece, the method for manufacturing an alloy ribbon piece may further include another heat treatment step to crystallize the amorphous alloy ribbon piece as a heat treatment step in addition to the first heat treatment step and the second heat treatment step. For example, the method for manufacturing an alloy ribbon piece may be a method that includes: the first heat treatment step as a first heat treatment step of sequentially heating an amorphous alloy ribbon piece from one end to a first intermediate position toward another end to a temperature range equal to or more than a crystallization starting temperature, and stopping the heating when heating the amorphous alloy ribbon piece up to the first intermediate position to the temperature range equal to or more than the crystallization starting temperature; and the second heat treatment step as a second heat treatment step of sequentially heating the amorphous alloy ribbon piece from the first intermediate position to a second intermediate position toward the other end to the temperature range equal to or more than the crystallization starting temperature after the heating is stopped in the first heat treatment step, and stopping the heating when heating the amorphous alloy ribbon piece up to the second intermediate position to the temperature range equal to or more than the crystallization starting temperature, and the method further includes a third heat treatment step of heating a region on the other end side with respect to the second intermediate position of the amorphous alloy ribbon piece to the temperature range equal to or more than the crystallization starting temperature after the heating is stopped in the second heat treatment step. In this example, the heating condition for each heat treatment step is high, for example, in the order of the third heat treatment step, the second heat treatment step, and the first heat treatment step. The region on the other end side with respect to the second intermediate position of the amorphous alloy ribbon piece may be small in size such that the excessive temperature rise causing the coarse crystal grains does not occur even if the region is simultaneously heated to the temperature range equal to or more than the crystallization starting temperature.

In the exemplary manufacturing method of the embodiment illustrated in FIG. 1A to FIG. 2B, the region on the outer edge 2*e* side with respect to the intermediate position 2*m* of the amorphous alloy ribbon piece 2A heated in the second heat treatment step is smaller than the region from the inner edge 2*s* to the intermediate position 2*m* of the amorphous alloy ribbon piece 2A heated in the first heat treatment step. The method for manufacturing an alloy ribbon piece may be, for example, as this example, a method where the region on the other end side with respect to the intermediate position of the amorphous alloy ribbon piece is smaller than the region from the one end to the intermediate position of the amorphous alloy ribbon piece. This is because, since the generated heat due to crystallization in the region on the other end side with respect to the intermediate position generated by the heating in the second heat treatment step is easily escaped to the region on the one end side with respect to the intermediate position, the excessive temperature rise can be effectively suppressed. For example, as this example, the region on the other end side with respect to the intermediate position of the amorphous alloy ribbon piece heated in the second heat treatment step may be small in size such that the excessive temperature rise causing the coarse crystal grains does not occur even if the region is simultaneously heated to the temperature range equal to or more than the crystallization starting temperature.

Here, FIG. 5A to FIG. 7C are schematic process drawings illustrating another exemplary embodiment of the method for manufacturing an alloy ribbon piece according to the disclosure.

Figure 5A:
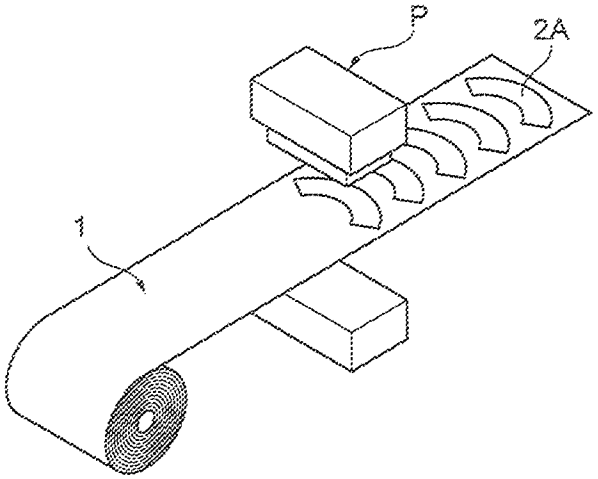
FIGS. 5A to 5C are schematic process drawings illustrating another exemplary embodiment of the method for manufacturing an alloy ribbon piece according to the disclosure.

In the manufacturing method as the other exemplary embodiment, first, as illustrated in FIG. 5A, a continuous sheet-shaped amorphous alloy ribbon 1 (for example, NANOMET (thickness T: 25 μm) manufactured by Tohoku Magnet Institute) manufactured by a common method is punched with a pressing machine P to prepare a plurality of (for example, 400 pieces) amorphous alloy ribbon pieces 2A (preparation step). Since the amorphous alloy ribbon piece 2A has a shape into which a circular alloy ribbon constituting a motor stator core is divided in a circumferential direction in one third, the amorphous alloy ribbon piece 2A has a teeth portion (not illustrated) on an inner edge (one end) side, and a back yoke portion (not illustrated) on an outer edge (other end) side.

Figure 5B:
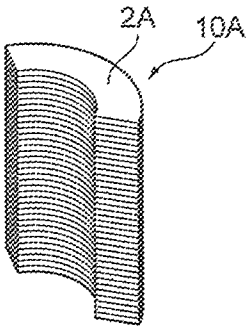
Figure 5C:
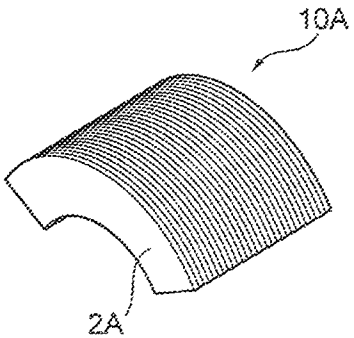
Figure 6A:
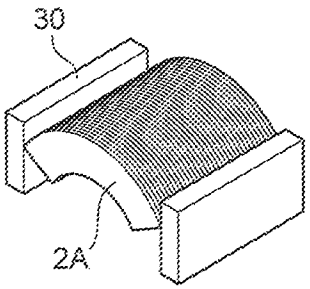
FIGS. 6A to 6C are schematic process drawings illustrating the other exemplary embodiment of the method for manufacturing an alloy ribbon piece according to the disclosure.

Next, as illustrated in FIG. 5B, the plurality of amorphous alloy ribbon pieces 2A are laminated to form a laminated body 10A. Subsequently, as illustrated in FIG. 5C and FIG. 6A, the laminated body 10A is put sideways, and a jig 30 including a pair of plate-shaped members is used to fix the laminated body 10A by sandwiching the plurality of amorphous alloy ribbon pieces 2A at circumferential both ends with a clearance of 1 mm provided between the adjacent alloy ribbon pieces.

Figure 6B:
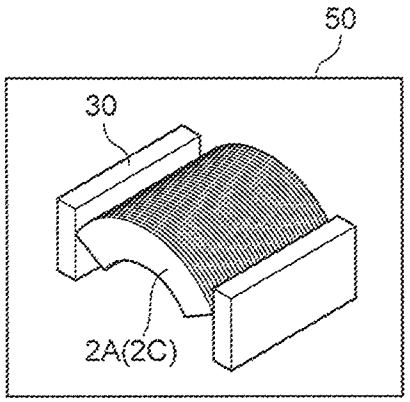

Next, as illustrated in FIG. 6B, in a state where the plurality of amorphous alloy ribbon pieces 2A fixed by the jig 30 are put in heat treatment equipment 50 under an air atmosphere at normal temperature, by sending a high temperature gas (not illustrated) at 420° C. from a high temperature gas source (not illustrated) fixed at a position facing the inner edges 2*s* of the plurality of amorphous alloy ribbon pieces 2A toward the plurality of amorphous alloy ribbon pieces 2A with a velocity of 2.5 m/s for 10 seconds, the high temperature gas is applied to the plurality of amorphous alloy ribbon pieces 2A such that the high temperature gas enters the clearance between the adjacent amorphous alloy ribbon pieces 2A, and subsequently, the sending of the high temperature gas is stopped. Thus, the whole region in the width direction is sequentially heated from the inner edge of the plurality of amorphous alloy ribbon pieces 2A to the intermediate position toward the outer edge to the temperature range equal to or more than the crystallization starting temperature, and the heating of the amorphous alloy ribbon pieces 2A is stopped when the whole region in the width direction is heated up to the intermediate position to the temperature range equal to or more than the crystallization starting temperature (first heat treatment step).

Next, after the elapse of one second from the stop of the sending of the high temperature gas in the first heat treatment step, by sending the high temperature gas (not illustrated) at 450° C., which is higher than that in the first heat treatment step, from the same high temperature gas source fixed at the same position toward the plurality of amorphous alloy ribbon pieces 2A with the velocity of 2.5 m/s for 10 seconds, the high temperature gas is applied to the plurality of amorphous alloy ribbon pieces 2A such that the high temperature gas enters the clearance between the adjacent amorphous alloy ribbon pieces 2A, and subsequently, the sending of the high temperature gas is stopped. Thus, at a timing later than the timing at which the heating is stopped in the first heat treatment step, the whole region in the width direction is sequentially heated from the inner edge of the plurality of amorphous alloy ribbon pieces 2A to the outer edge to the temperature range equal to or more than the crystallization starting temperature, the whole of the amorphous alloy ribbon pieces 2A including the region on the outer edge side with respect to the intermediate position is thereby heated to the temperature range equal to or more than the crystallization starting temperature, and subsequently, the heating is stopped (second heat treatment step). As described above, the whole of the plurality of amorphous alloy ribbon pieces 2A is crystallized to manufacture a plurality of nanocrystalline alloy ribbon pieces 2C.

Figure 6C:
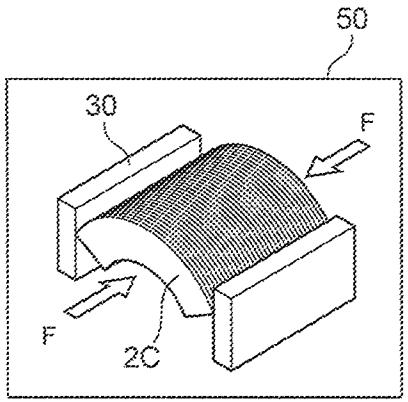
Figure 7C:
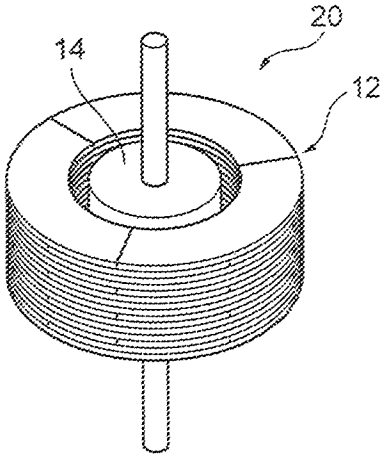
FIGS. 7A to 7C are schematic process drawings illustrating the other exemplary embodiment of the method for manufacturing an alloy ribbon piece according to the disclosure.
Figure 7B:
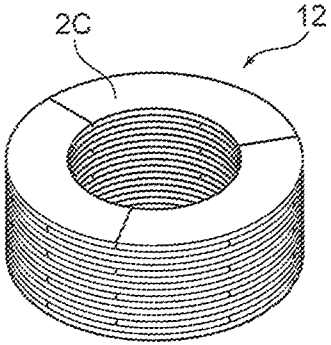
Figure 7A:
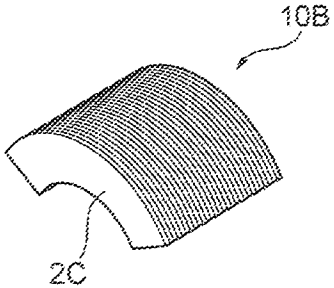

Next, as illustrated in FIG. 6C and FIG. 7A, the plurality of nanocrystalline alloy ribbon pieces 2C are brought in close contact with one another with a pressure F to form a laminated body 10B, and the laminated body 10B is taken out from the heat treatment equipment 50. Subsequently, the plurality of nanocrystalline alloy ribbon pieces 2C of the laminated body 10B are rotated and laminated to manufacture a stator core 12 as illustrated in FIG. 7B. Subsequently, as illustrated in FIG. 7C, the stator core 12 is combined with a rotor 14, a coil (not illustrated), and a case (not illustrated) to manufacture a motor 20.

The method for manufacturing an alloy ribbon piece may be the manufacturing method as the other example described here. This is because, since a plurality of nanocrystalline alloy ribbon pieces obtained by crystallizing the amorphous alloy ribbon piece can be manufactured at the same time, the nanocrystalline alloy ribbon piece can be easily mass-produced.

The method for manufacturing an alloy ribbon piece is not specifically limited insofar as the nanocrystalline alloy ribbon piece can be manufactured, but may be a manufacturing method where, for example, the whole of the amorphous alloy ribbon piece is crystallized to obtain a desired grain diameter of the crystal grain of the nanocrystalline alloy ribbon piece without substantially causing the precipitation of the compound phase and the coarse crystal grains. In the method for manufacturing an alloy ribbon piece, in order to crystallize the whole of the amorphous alloy ribbon piece to obtain the desired grain diameter of the crystal grain of the nanocrystalline alloy ribbon piece without substantially causing the precipitation of the compound phase and the coarse crystal grains, other conditions may be appropriately set in addition to the above-described conditions. Not only the respective conditions are appropriately set independently, but also combinations of the respective conditions may be appropriately set.

EXAMPLES

The following further specifically describes the method for manufacturing an alloy ribbon piece according to the embodiment with Examples and Comparative Examples.

Figure 8:
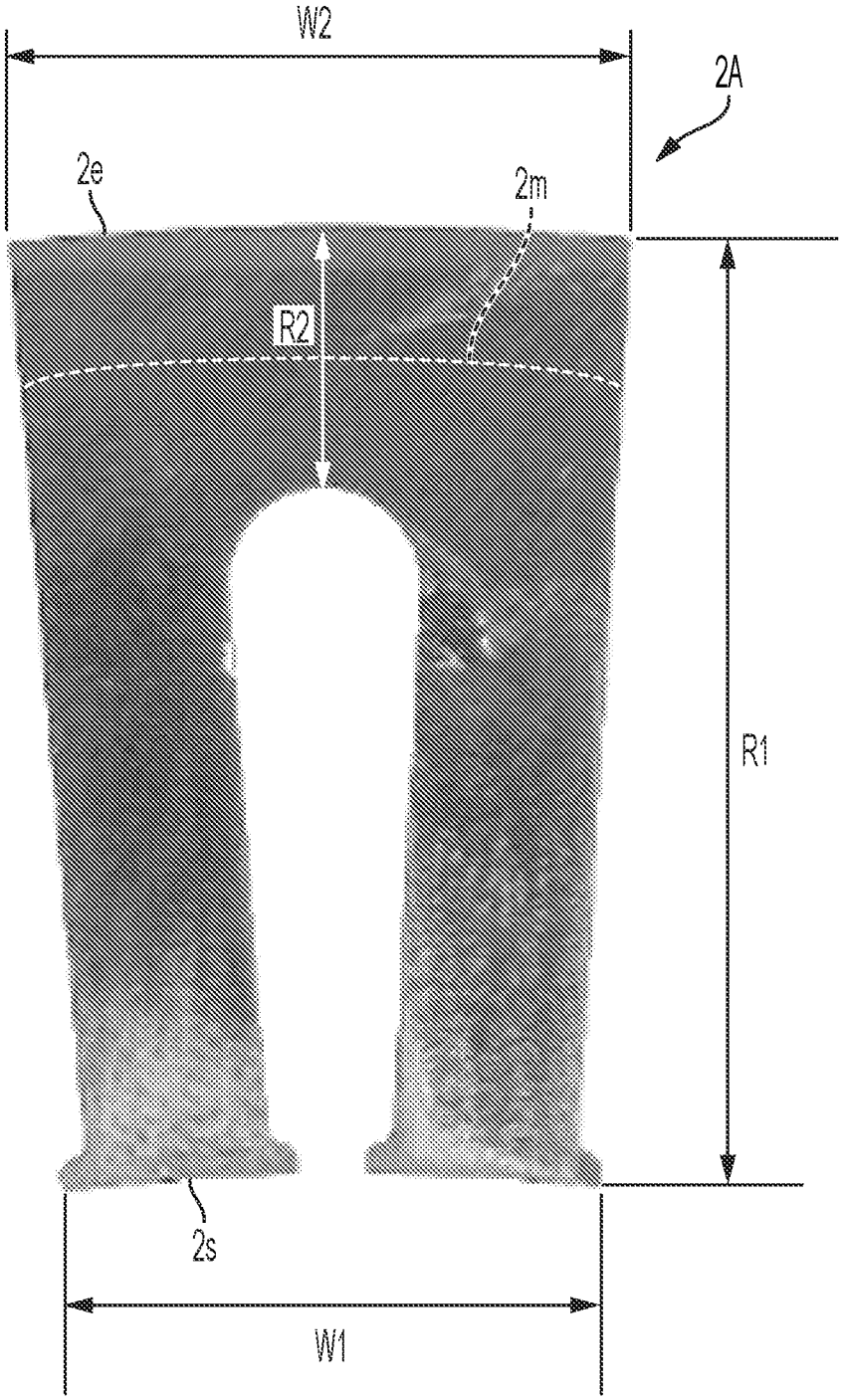
FIG. 8 is a photograph illustrating an exemplary amorphous alloy ribbon piece used in experiments on the methods for manufacturing an alloy ribbon piece of Examples and Comparative Examples.

FIG. 8 is a photograph illustrating an exemplary amorphous alloy ribbon piece used in experiments on the methods for manufacturing an alloy ribbon piece of Examples and Comparative Examples. As illustrated in FIG. 8, the amorphous alloy ribbon piece 2A used in the experiments on the methods for manufacturing an alloy ribbon piece of Examples and Comparative Examples is a ribbon having a shape into which a circular alloy ribbon constituting a motor stator core is divided. The amorphous alloy ribbon piece 2A is punched from an amorphous alloy ribbon (NANOMET manufactured by Tohoku Magnet Institute), and its size is as follows.

Thickness T: 25 μm
Whole Radial Length R1: 26 mm
Back Yoke Portion Radial Length R2: 7 mm
Inner Edge Length W1: 15 mm
Outer Edge Length W2: 18 mm The experiments of Examples and Comparative Examples were conducted in a state where the amorphous alloy ribbon piece 2A was put under the air atmosphere at normal temperature (20° C.). In the experiments of Examples and Comparative Examples, an industrial dryer (GHG 660LCD manufactured by Robert Bosch GmbH) equipped with a nozzle (1 609 201 795 manufactured by Robert Bosch GmbH) was used as the high temperature gas source.

Example 1

Figure 9C:
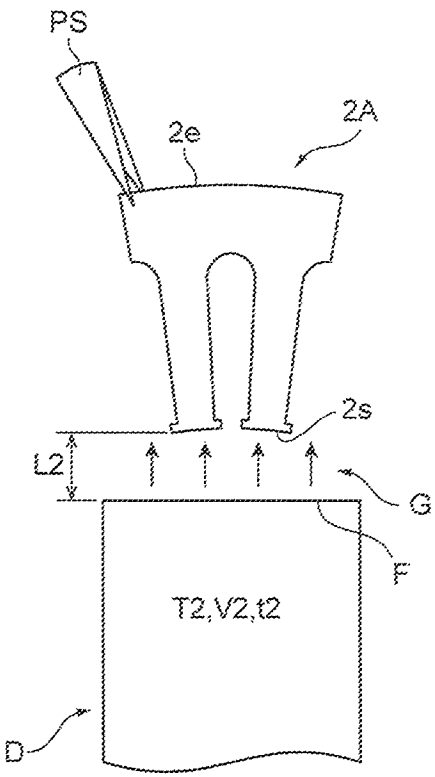
FIGS. 9A to 9C are schematic process drawings illustrating the experiments on the methods for manufacturing an alloy ribbon piece of Examples and Comparative Examples.
Figure 9B:
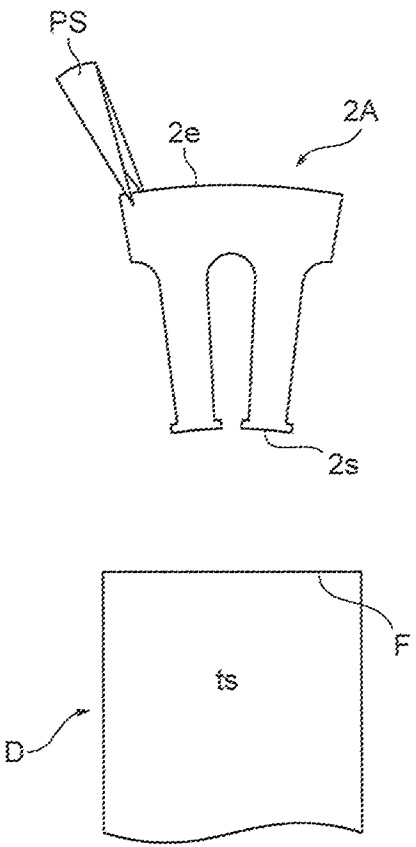
Figure 9A:
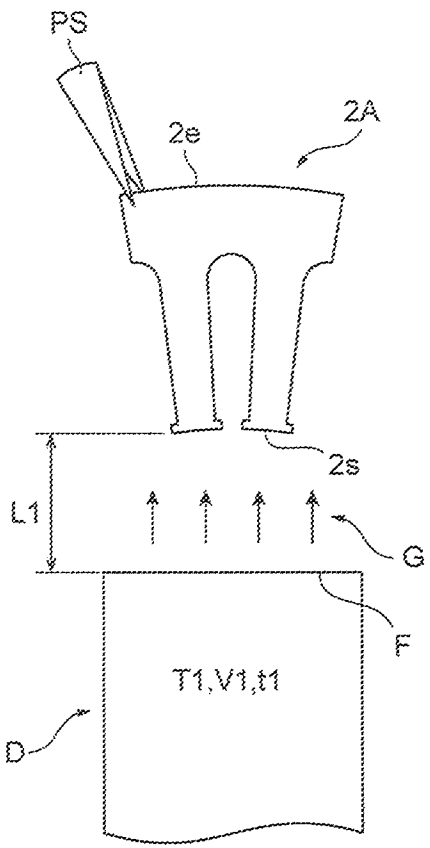

Here, FIG. 9A to FIG. 9C are schematic process drawings illustrating the experiments on the methods for manufacturing an alloy ribbon piece of Examples and Comparative Examples.

In the experiment of Example 1, first, as illustrated in FIG. 9A, a corner portion of the amorphous alloy ribbon piece 2A was grasped with tweezers PS, an industrial dryer D was fixed so as to have a nozzle F at a position facing the inner edge 2*s* of the amorphous alloy ribbon piece 2A apart from the inner edge 2*s* by a distance L1=10 mm. In this state, the high temperature gas G having a temperature T1=420° C. was sent with a velocity V1=2.5 m/s for a heating time t1=10 seconds from the industrial dryer D toward the amorphous alloy ribbon piece 2A, and subsequently, as illustrated in FIG. 9B, the sending of the high temperature gas G was stopped (first heat treatment step).

Next, after the elapse of a stop time ts=1 second from the stop of the sending of the high temperature gas G in the first heat treatment step as illustrated in FIG. 9B, the industrial dryer D was fixed so as to have the nozzle F at a position facing the inner edge 2*s* of the amorphous alloy ribbon piece 2A apart from the inner edge 2*s* by a distance L2=10 mm as illustrated in FIG. 9C. In this state, the high temperature gas G having a temperature T2=450° C. was sent with a velocity V2=2.5 m/s for a heating time t2=10 seconds from the industrial dryer D toward the amorphous alloy ribbon piece 2A, and subsequently, the sending of the high temperature gas G was stopped (second heat treatment step). Thus, the alloy ribbon piece obtained by crystallizing the amorphous alloy ribbon piece 2A was manufactured.

Comparative Example 1

The experiment of Comparative Example 1 was performed under the condition similar to that of Example 1 excluding that the temperature T1 of the high temperature gas G in the first heat treatment step was 450° C.

Example 2

In the experiment of Example 2, first, as illustrated in FIG. 9A, the corner portion of the amorphous alloy ribbon piece 2A was grasped with the tweezers PS, the industrial dryer D was fixed so as to have the nozzle F at the position facing the inner edge 2*s* of the amorphous alloy ribbon piece 2A apart from the inner edge 2*s* by the distance L1=10 mm. In this state, the high temperature gas G having the temperature T1=420° C. was sent with the velocity V1=2.5 m/s for the heating time t1=10 seconds from the industrial dryer D toward the amorphous alloy ribbon piece 2A, and subsequently, as illustrated in FIG. 9B, the sending of the high temperature gas G was stopped (first heat treatment step).

Next, after the elapse of the stop time ts=1 second from the stop of the sending of the high temperature gas G in the first heat treatment step as illustrated in FIG. 9B, the industrial dryer D was fixed so as to have the nozzle F at the position facing the inner edge 2*s* of the amorphous alloy ribbon piece 2A apart from the inner edge 2*s* by the distance L2=10 mm as illustrated in FIG. 9C. In this state, the high temperature gas G having the temperature T2=420° C. was sent with the velocity V2=5 m/s for the heating time t2=10 seconds from the industrial dryer D toward the amorphous alloy ribbon piece 2A, and subsequently, the sending of the high temperature gas G was stopped (second heat treatment step). Thus, the alloy ribbon piece obtained by crystallizing the amorphous alloy ribbon piece 2A was manufactured.

Comparative Example 2

The experiment of Comparative Example 2 was performed under the condition similar to that of Example 2 excluding that the velocity V1 of the high temperature gas G in the first heat treatment step was 5 m/s.

Example 3

In the experiment of Example 3, first, as illustrated in FIG. 9A, the corner portion of the amorphous alloy ribbon piece 2A was grasped with the tweezers PS, the industrial dryer D was fixed so as to have the nozzle F at the position facing the inner edge 2*s* of the amorphous alloy ribbon piece 2A apart from the inner edge 2*s* by the distance L1=30 mm. In this state, the high temperature gas G having the temperature T1=450° C. was sent with the velocity V1=2.5 m/s for the heating time t1=10 seconds from the industrial dryer D toward the amorphous alloy ribbon piece 2A, and subsequently, as illustrated in FIG. 9B, the sending of the high temperature gas G was stopped (first heat treatment step).

Next, after the elapse of the stop time ts=1 second from the stop of the sending of the high temperature gas G in the first heat treatment step as illustrated in FIG. 9B, the industrial dryer D was fixed so as to have the nozzle F at the position facing the inner edge 2*s* of the amorphous alloy ribbon piece 2A apart from the inner edge 2*s* by the distance L2=10 mm as illustrated in FIG. 9C. In this state, the high temperature gas G having the temperature T2=450° C. was sent with the velocity V2=2.5 m/s for the heating time t2=10 seconds from the industrial dryer D toward the amorphous alloy ribbon piece 2A, and subsequently, the sending of the high temperature gas G was stopped (second heat treatment step). Thus, the alloy ribbon piece obtained by crystallizing the amorphous alloy ribbon piece 2A was manufactured.

Comparative Example 3

The experiment of Comparative Example 3 was performed under the condition similar to that of Example 3 excluding that the industrial dryer D was fixed so as to have the nozzle F at the position apart from the inner edge 2*s* of the amorphous alloy ribbon piece 2A by the distance L1=10 mm in the first heat treatment step.

Evaluation

A description will be given of the evaluation of the results of the experiments on the methods for manufacturing an alloy ribbon piece of Examples and Comparative Examples, and the crystallized alloy ribbon pieces manufactured in these experiments.

Appearance Observation

In the experiments on the methods for manufacturing an alloy ribbon piece of Examples and Comparative Examples, appearance change of the amorphous alloy ribbon piece 2A was visually observed.

As a result, in Example 1, it was observed that, as illustrated in FIG. 8, in the first heat treatment step, the amorphous alloy ribbon piece 2A had colors sequentially changed from shiny silver to shiny blue from the inner edge 2*s* to the intermediate position 2*m* toward the outer edge 2*e*, and in the second heat treatment step, the amorphous alloy ribbon piece 2A had the colors sequentially changed from shiny silver to shiny blue from the intermediate position 2*m* to the outer edge 2*e*. Accordingly, it is considered that, in the first heat treatment step, the amorphous alloy ribbon piece 2A was sequentially crystallized from the inner edge 2*s* to the intermediate position 2*m* toward the outer edge 2*e*, and the excessive temperature rise did not occur because the generated heat due to crystallization at that time was escaped to the region on the outer edge 2*e* side with respect to the intermediate position 2*m*. In addition, it is considered that, in the second heat treatment step, the amorphous alloy ribbon piece 2A was sequentially crystallized from the intermediate position 2*m* to the outer edge 2*e* sequentially, and the excessive temperature rise did not occur because the generated heat due to crystallization at that time was escaped to the region on the inner edge 2*s* side with respect to the intermediate position 2*m*.

In contrast, in Comparative Example 1, it was observed that, in the first heat treatment step, the color of the amorphous alloy ribbon piece 2A sequentially changed from the inner edge 2*s* to the outer edge 2*e* from shiny silver to shiny blue, and furthermore, the color of the proximity of the outer edge 2*e* changed from shiny blue to gray. In the second heat treatment step, the appearance of the amorphous alloy ribbon piece 2A did not change. Accordingly, it is considered that, in the first heat treatment step, the amorphous alloy ribbon piece 2A was sequentially crystallized from the inner edge 2*s* to the outer edge 2*e*, and the excessive temperature rise occurred at the proximity of the outer edge 2*e* because of the generated heat due to crystallization at that time. In addition, it is considered that, the amorphous alloy ribbon piece 2A was not crystallized in the second heat treatment step because the whole of the amorphous alloy ribbon piece 2A was crystallized in the first heat treatment step.

Figure 10:
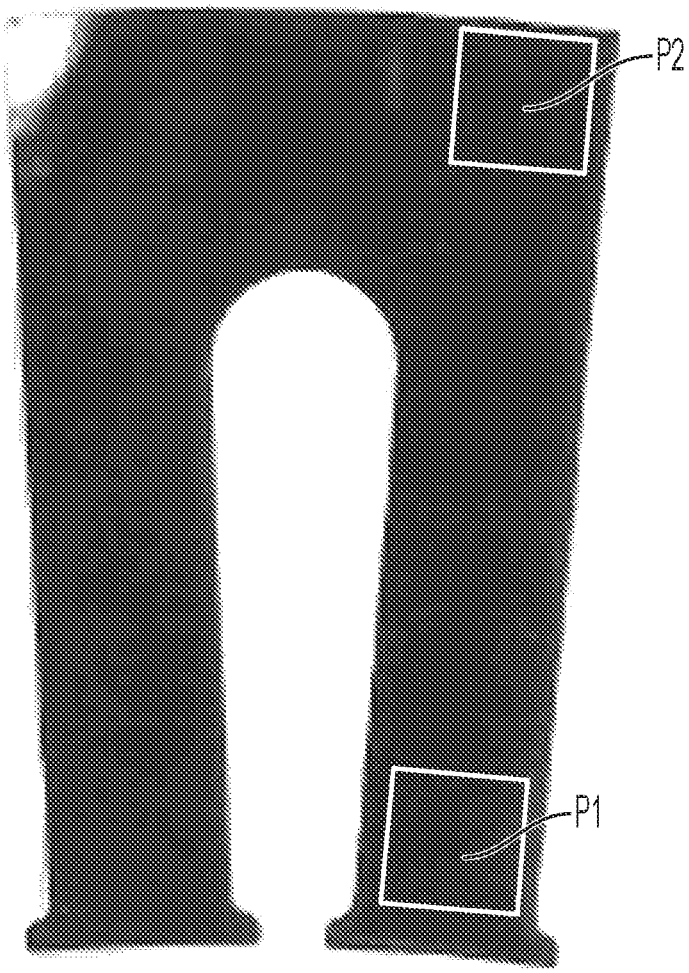
FIG. 10 is a photograph illustrating an exemplary crystallized alloy ribbon piece manufactured in the experiments on the methods for manufacturing an alloy ribbon piece of Examples and Comparative Examples.

In Examples 2 and 3, the appearance change in the first heat treatment step and the second heat treatment step was similar to that of Example 1. In Comparative Examples 2 and 3, the appearance change in the first heat treatment step and the second heat treatment step was similar to that of Comparative Example 1. FIG. 10 is a photograph illustrating an exemplary crystallized alloy ribbon piece manufactured in the experiments on the methods for manufacturing an alloy ribbon piece of Examples and Comparative Examples.

Saturation Magnetic Flux Density and Coercivity

For the crystallized alloy ribbon pieces manufactured in the experiments of Examples and Comparative Examples, a part of a position P1 in the proximity of the inner edge and a part of a position P2 in the proximity of the outer edge illustrated in FIG. 10 were cut out, and the saturation magnetic flux densities and the coercivities at the position P1 in the proximity of the inner edge and the position P2 in the proximity of the outer edge were measured with the vibrating sample magnetometer (VSM). The measurement values and the evaluation results are indicated in Table 1. The saturation magnetic flux densities and the coercivities of the amorphous alloy ribbon pieces 2A before the crystallization used in the experiments on the methods for manufacturing an alloy ribbon piece of Examples and Comparative Examples were measured with the VSM at each position in the planar direction, and they were less than 1.7 T and less than 6 A/m, respectively. Especially, for the amorphous alloy ribbon piece 2A before the crystallization used in the experiment on the method for manufacturing an alloy ribbon piece of Example 1, the saturation magnetic flux density and the coercivity at the position P1 in the proximity of the inner edge were 1.675 T and 5.114 A/m, respectively, and the saturation magnetic flux density and the coercivity at the position P2 in the proximity of the outer edge were 1.617 T and 5.589 A/m, respectively.

TABLE 1

| | Heat Treatment Condition | | | | | | | | |
|---|---|---|---|---|---|---|---|---|---|
| | First Heat Treatment Step | | | | | Second Heat Treatment Step | | | |
| | High Temperature Gas Temperature T1 [° C.] | High Temperature Gas Velocity V1 [m/s] | Heating Time t1 [s] | Distance L1 to Nozzle F [mm] | Stop Time ts [s] | High Temperature Gas Temperature T2 [° C.] | High Temperature Gas Velocity V2 [m/s] | Heating Time t2 [s] | Distance L2 to Nozzle F [mm] |
| Example 2 | 420 | 2.5 | 10 | 10 | 1 | 450 | 2.5 | 10 | 10 |
| Comparative Example 1 | 450 | 2.5 | 10 | 10 | 1 | 450 | 2.5 | 10 | 10 |
| Example 2 | 420 | 2.5 | 10 | 10 | 1 | 420 | 5 | 10 | 10 |
| Comparatve Example 2 | 420 | 5 | 10 | 10 | 1 | 420 | 5 | 10 | 10 |
| Example 3 | 450 | 2.5 | 10 | 30 | 1 | 450 | 2.5 | 10 | 10 |
| Comparative Example 3 | 450 | 2.5 | 10 | 10 | 1 | 450 | 2.5 | 10 | 10 |

| | Evaluation of Saturation Magnetic Flux Density and Coercivity | | | | | | | |
|---|---|---|---|---|---|---|---|---|
| | Position P1 on Inner Edge Side | | | | Position P2 on Outer Edge Side | | | |
| | Saturation Magnetic Flux Density [T] | Saturation Magnetic Flux Density Evaluation | Coercivity [A/m] | Coercivity Evaluation | Saturation Magnetic Flux Density [T] | Saturation Magnetic Flux Density Evaluation | Coercivity [A/m] | Coercivity Evaluation |
| Example 2 | 1.71 | Good | 9.647 | Good | 1.733 | Good | 6.998 | Good |
| Comparative Example 1 | 1.737 | Good | 7.353 | Good | 1.765 | Good | 3365.00 | Poor |
| Example 2 | 1.714 | Good | 9.432 | Good | 1.728 | Good | 7.344 | Good |
| Comparatve Example 2 | 1.731 | Good | 8.991 | Good | 1.752 | Good | 3182.00 | Poor |
| Example 3 | 1.714 | Good | 9.432 | Good | 1.728 | Good | 7.344 | Good |
| Comparative Example 3 | 1.717 | Good | 9.361 | Good | 1.752 | Good | 3182.00 | Poor |

*1 Underlined values in heat treatment conditions of Examples 1, 2, and 3 are values different from values in heat treatment conditions of Comparative Examples 1, 2, and 3, respectively.
*2 Saturation magnetic flux density evaluations of position P1 on inner edge side and position P2 on outer edge side are evaluation results below. Good: Saturation magnetic flux density of 1.7 T or more Poor: Saturation magnetic flux density of less than 1.7 T
*3 Coercivity evaluations of position P1 on inner edge side and position P2 on outer edge side are evaluation results below. Good: Coercivity of 10 m/A or less Poor: Coercivity of more than 10 m/A As indicated in Table 1 above, for any of the crystallized alloy ribbon pieces manufactured in Examples 1 to 3, both of the saturation magnetic flux density at the position P1 on the inner edge side and the saturation magnetic flux density at the position P2 on the outer edge side were equal to or more than a lower limit (1.7 T) of the target range, and both of the coercivity at the position P1 on the inner edge side and the coercivity at the position P2 on the outer edge side were within the target range without exceeding the upper limit (10 A/m) of the target range. Meanwhile, for any of the crystallized alloy ribbon pieces manufactured in Comparative Examples 1 to 3, the coercivity at the position P1 on the inner edge side was within the target range while the coercivity at the position P2 on the outer edge side largely exceeded the upper limit (10 A/m) of the target range. It is considered that the coarse crystal grains and the like were caused at the position P2 on the outer edge side.

While the embodiment of the method for manufacturing an alloy ribbon piece according to the present disclosure have been described in detail above, the present disclosure is not limited thereto, and can be subjected to various kinds of changes in design without departing from the spirit of the present disclosure described in the claims.

All publications, patents and patent applications cited in the present description are herein incorporated by reference as they are.

DESCRIPTION OF SYMBOLS

2A Amorphous alloy ribbon piece

2*s* Inner edge (one end) of amorphous alloy ribbon piece

2*e* Outer edge (other end) of amorphous alloy ribbon piece

2*m* Intermediate position between inner edge and outer edge of amorphous alloy ribbon piece GS High temperature gas source
G High temperature gas

What is claimed is:

1. A method for manufacturing an alloy ribbon piece obtained by crystallizing an amorphous alloy ribbon piece, the method comprising:

preparing the amorphous alloy ribbon piece;

sequentially heating a whole region of the amorphous alloy ribbon piece in a width direction from one end to an intermediate position toward the other end of the amorphous alloy ribbon piece to a temperature range equal to or more than a crystallization starting temperature, and keeping a temperature of a region on the other end side with respect to the intermediate position of the amorphous alloy ribbon piece in a temperature range less than the crystallization starting temperature by stopping the heating in the sequentially heating when the heating of the amorphous alloy ribbon piece reaches the intermediate position;

escaping a first heat due to crystallization to the region on the other end side with respect to the intermediate position of the amorphous alloy ribbon piece when the first heat due to crystallization is sequentially generated from the one end to the intermediate position of the amorphous alloy ribbon piece by the heating in the sequentially heating from the one end to the intermediate position;

sequentially heating the whole region of the amorphous alloy ribbon piece in a width direction from the one end to the other end of the amorphous alloy ribbon piece to the temperature range equal to or more than the crystallization starting temperature after the stopping of the heating in the sequentially heating from the one end to the intermediate position, and sequentially, stopping the sequentially heating from the one end to the other end; and escaping a second heat due to crystallization to a region from the one end to the intermediate position of the amorphous alloy ribbon piece when the second heat due to crystallization is generated in the region from the position adjacent to the intermediate position to the other end of the amorphous alloy ribbon piece by the heating in the sequentially heating from the one end to the other end, wherein both of the heating in the sequentially heating from the one end to the intermediate position and the heating in the sequentially heating from the one end to the other end are carried out with the same heat source facing the one end of the amorphous alloy ribbon piece.

2. The method for manufacturing an alloy ribbon piece according to claim 1, wherein the region on the other end side with respect to the intermediate position of the amorphous alloy ribbon piece is smaller than the region from the one end to the intermediate position of the amorphous alloy ribbon piece.

3. The method for manufacturing an alloy ribbon piece according to claim 1, wherein the heating of the region from the one end to the other end of the amorphous alloy ribbon piece to the temperature range equal to or more than the crystallization starting temperature takes place after an elapse of 0.1 seconds or more from the stopping of the heating in the sequentially heating.

* * * * *